United States Patent [19]

Ellis

[11] 4,014,571

[45] Mar. 29, 1977

[54] LOCKING MEANS FOR DOORS AND WINDOWS

[76] Inventor: Rollo G. Ellis, 6409 War Eagle Lane, Charlotte, N.C. 28214

[22] Filed: Nov. 28, 1975

[21] Appl. No.: 636,135

[52] U.S. Cl. ..... 292/300; 16/137

[51] Int. Cl.[2] ..... E05C 19/00

[58] Field of Search ..... 16/128 R, 135, 137, 16/148, 170, 171; 49/381, 383, 394, 395, 398, 399; 292/300, DIG. 17, DIG. 41

[56] References Cited

UNITED STATES PATENTS

| | | | |
|---|---|---|---|
| 323,342 | 7/1885 | Kitson | 292/300 X |
| 340,991 | 5/1886 | Diehl | 292/300 X |
| 1,111,135 | 9/1914 | Carlson | 292/300 UX |
| 1,421,746 | 7/1922 | Thorne | 292/300 |
| 1,579,848 | 4/1926 | Veno | 292/300 UX |
| 1,738,183 | 12/1929 | Hickman | 16/171 X |
| 2,223,676 | 12/1940 | Dinsmore et al. | 16/170 X |
| 2,729,862 | 1/1956 | Marjama | 292/300 X |
| 3,166,144 | 1/1965 | Price | 292/DIG. 41 |
| 3,911,622 | 10/1975 | Prohaska | 292/300 X |

FOREIGN PATENTS OR APPLICATIONS

| | | | |
|---|---|---|---|
| 431,937 | 7/1926 | Germany | 16/137 |

*Primary Examiner*—Lawrence J. Staab
*Attorney, Agent, or Firm*—Harry R. Dumont

[57] ABSTRACT

A locking device for doors and windows which are disposed in a jamb and are provided with hinges having an exposed removable pin, the device comprising a pair of plates each having an angled end portion, one of the plates being mounted on the back of the door or window proximate each hinge, and the other plate being mounted on the jamb with its angled end portion projecting behind the angled end portion of the plate mounted on the back of the door or window when the door or window is in a closed position. Although the hinge pins may be removed, the door or window is prevented from being pryed away from the jamb by the interfering angled end portions of the plates.

2 Claims, 7 Drawing Figures

FIG. 1
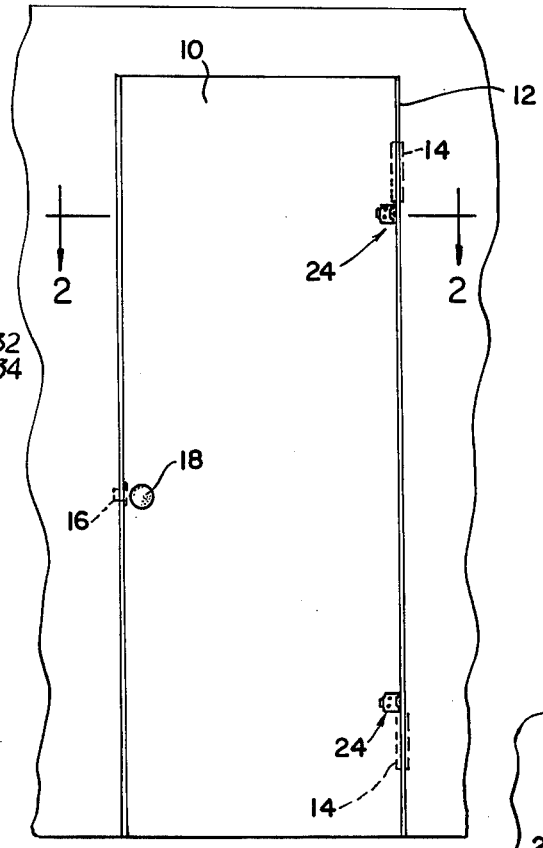
FIG. 5
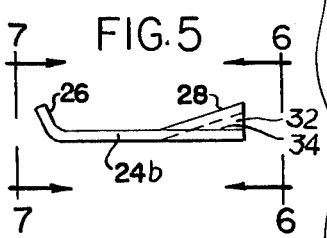
FIG. 6
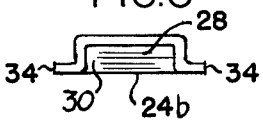
FIG. 7
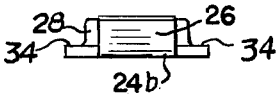
FIG. 3
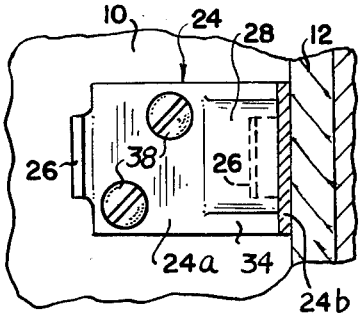
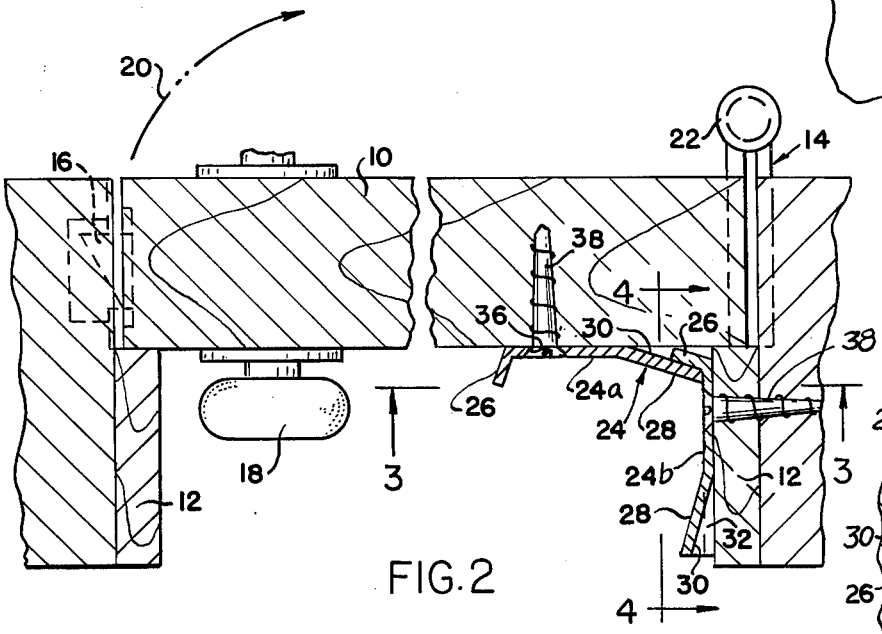
FIG. 2
FIG. 4
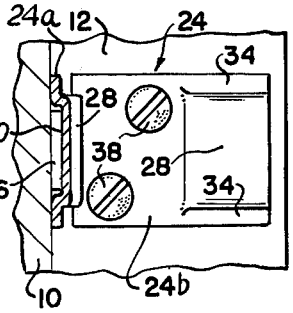

LOCKING MEANS FOR DOORS AND WINDOWS

BACKGROUND OF THE INVENTION

The present invention relates to building hardware and more particularly to a device which may be mounted on a door or window for preventing unauthorized removal of the door or window, although the pins of the hinges supporting the door or window are accessible and may be removed.

It is common practice in many parts of the country, due to fire regulations applicable to public buildings as well as, in some cases, to private dwellings, to use outwardly opening doors rather than inwardly opening doors. Outwardly opening doors are mounted on hinges whose hinging line is on the outside, such that the hinge pintles or pins are easily accessible to unauthorized persons who, after removing the pins, may pry the door loose from the door jamb and obtain access to the building, to the room or to a closet, although the door may be locked in the usual manner. In the past, some devices have been provided which are incorporated in the hinges, and which tend to prevent unauthorized removal of outwardly swinging doors or windows. Such devices generally include a pin or tongue projecting from one leaf of the hinge through the other leaf and into a recess in the door side or in the jamb when the door or window is closed, such that the hinge leaves may not be separated although the hinge pin may have been removed.

The present invention provides a safety locking device which forms no part of a door or window hinge such that it may be used in combination with conventional hinges or as an add-on feature without requiring changing the door or window hinges and drilling additional holes for the passage of pins or tongues into the side of a door or a door jamb.

SUMMARY OF THE INVENTION

The present invention therefore provides a door or window locking device, independent of the door or window hinges, which, in its preferred form, consists of a pair of identical stamped plates with angled end portions adapted to provide an interference when one of the plates is mounted on the back of a door or window and the other is mounted on the jamb proximate the door or window hinge.

BRIEF DESCRIPTION OF THE DRAWING

The present invention will be best understood by those skilled in the art when the following description of the best mode contemplated for practicing the invention is read in conjunction with the accompanying drawing wherein like reference numerals refer to like parts and in which:

FIG. 1 is a schematic rear view of an outwardly opening door provided with the locking device of the present invention;

FIG. 2 is an enlarged partial sectional view along line 2—2 of FIG. 1;

FIG. 3 is a partial elevational and sectional view along line 3—3 of FIG. 2;

FIG. 4 is a partial elevational and sectional view along line 4—4 of FIG. 2;

FIG. 5 is a side view of a locking element according to the present invention;

FIG. 6 is an end elevational view thereof from line 6—6 of FIG. 5; and

FIG. 7 is an end elevational veiw thereof from line 7—7 of FIG. 5.

DETAILED DESCRIPTION OF THE PREFERRED EMBODIMENT

Referring now to the drawing, and more particularly to FIGS. 1–2 thereof, an outwardly opening door 10 is shown in elevation from the interior of a building or closet, hingingly mounted within a door jamb 12. The door 10 is supported by a pair of conventional hinges 14, and is normally held closed by a latch 16 operated by a handle or knob 18. A conventional lock, not shown, may form part of the latch 16 and knob 18 assembly, and additional locks, if so desired, may be provided for normally holding the door in a closed and locked position preventing unauthorized ingress into the building or other enclosure.

As best shown at FIG. 2, in order to provide outward opening of the door in the direction of the arrow 20, each hinge 14 has its hinging line disposed on the outside such that the hinge pintle or pin 22 is accessible also from the outside. Unauthorized persons desiring to gain access to the enclosure protected by the door 10 may thus be tempted to remove the hinge pins 22 and, by prying the door outwardly, remove the door from the jamb 12 and gain access to the enclosure.

The present invention, in the form illustrated, prevents such prying open of the door 10 by providing a pair of generally rectangular locking plates, generally designated by numeral 24, mounted on the back of the door and on a corresponding portion of the jamb 12 proximate and opposite to the hinges 14. As best shown in the detailed views of FIGS. 2–6, the two plates **24*a* and 24*b* of a pair of plates 24 are preferably identical, a single plate 24*a* being illustrated at FIGS. 5–7. The plates 24*a* and 24*b* are each provided on one end with an angled projecting portion 26, in the form of a narrowed tongue, and on the other end with an angled or bent portion 28 preferably formed as a result of shaping the plate 24*a* or 24*b* as shown, such as to define a rearwardly tapered recess 30 provided with triangular sidewalls 32, the side portion 34 of the plate adjoining the triangular sidewalls 32 remaining substantially coplanar with the remaining of the body of the plate 24*a* or 24*b*.**

Each plate, **24*a* or 24*b*, is provided with a pair of mounting holes 26, FIG. 2, for accepting appropriate fastening means such as screws 38 for mounting of one of the plates of a pair, such as plate 24*a*, on the back of the door 10, and the other plate 24*b* on the jamb 12. Preferably, the plate 24*a* is mounted in such a manner that the recess 30, when the door 10 is closed, is presented to the projecting tongue 26 of the other plate 24*b* of a pair, such that the upper surface of the tongue 26 engages the lower surface of the angled portion 28. The angle formed by the angled portion 28 of each plate is preferably less than 45° relative to the plate of the body of the plate, and the angle formed by the tongue 26 relative to the plane of the body of the plate is an angle which is complementary to that formed by the angled end portion 28.**

The preferred structure of the invention contemplates that the plates **24*a* and 24*b* are identical, with the result that the cost of tooling and inventory of parts is substantially reduced. The plates are particularly adapted for forming from steel stampings. It would be readily apparent that other methods of manufacture, such as casting, are available, and that the plates forming an interlocking pair may be of different shape. For example, one plate may be provided with a projecting tongue and the other plate provided with an appropriate recess into which the tongue of the first plate projects when the door is closed. It will also be readily apparent that although the structure of the embodiment of the present invention as disclosed prevents the door 10 from being removed, the particular structure of the plates 24***a* and 24*b* does not cause any interference with the normal operation of the door or window when the plates are properly mounted.

Having thus described the present invention by way of a practical embodiment thereof, modifications whereof will be apparent to those skilled in the art.

What is claimed as novel is as follows:

1. A locking device for a door or window disposed in a jamb and provided with hinging means having a removable pin, said device comprising a first plate mounted on said door or window proximate and opposite to said hinging means, a first angled end portion on said first plate, a second plate mounted on said jamb, a second angled end portion on said second plate engageable behind the first angled end portion of said first plate upon closure of said door or window for preventing said door or window from being removed from said jamb after removal of said pin said first and second plates being identical and each having one of said angled portions on each end thereof, the first of said angled portions being at a first angle of less than 45° relative to said plate and the second being at a second angle complementary of said first angle.

2. The locking device of claim 1 wherein each of said plates comprises a steel stamping and said first angled portion of each is in the form of a tongue projecting from an end of said plate and said second angled portion of each is in the form of a rearwardly tapered recess formed by a bent end portion of said plate and disposed between sides of said plate substantially coplanar with said plate.

* * * * *